US010092921B2

(12) United States Patent
Muller

(10) Patent No.: US 10,092,921 B2
(45) Date of Patent: Oct. 9, 2018

(54) FLUID PRODUCT RESERVOIR AND DISPENSER INCORPORATING SUCH A RESERVOIR

(71) Applicant: APTAR FRANCE SAS, Le Neubourg (FR)

(72) Inventor: Patrick Muller, Saint Aubin sur Gaillon (FR)

(73) Assignee: APATAR FRANCE SAS, Le Neubourg (FR)

( * ) Notice: Subject to any disclaimer, the term of this patent is extended or adjusted under 35 U.S.C. 154(b) by 0 days.

(21) Appl. No.: 15/111,926

(22) PCT Filed: Jan. 16, 2015

(86) PCT No.: PCT/FR2015/050111

§ 371 (c)(1),
(2) Date: Jul. 15, 2016

(87) PCT Pub. No.: WO2015/107306

PCT Pub. Date: Jul. 23, 2015

(65) Prior Publication Data

US 2016/0346799 A1 Dec. 1, 2016

(30) Foreign Application Priority Data

Jan. 17, 2014 (FR) ..... 14 50382

(51) Int. Cl.
*B05B 11/00* (2006.01)
*A45D 34/00* (2006.01)

(52) U.S. Cl.
CPC ..... *B05B 11/3047* (2013.01); *A45D 34/00* (2013.01); *B05B 11/0048* (2013.01); *B05B 11/0054* (2013.01); *A45D 2034/005* (2013.01)

(58) Field of Classification Search
CPC B65D 47/247; B65D 47/283; B65D 51/2864; B65D 51/2892; B05B 11/0043;
(Continued)

(56) References Cited

U.S. PATENT DOCUMENTS 2,808,966 A * 10/1957 Hall ..... B67D 1/0425 222/207
3,245,587 A * 4/1966 Brown ..... B65D 47/283 222/182

(Continued)

FOREIGN PATENT DOCUMENTS

| | | |
|---|---|---|
| EP | 1 422 076 A1 | 5/2004 |
| FR | 2 860 959 A1 | 4/2005 |
| WO | 99/16552 A1 | 4/1999 |

OTHER PUBLICATIONS

International Preliminary Report on Patentability issued from the International Bureau in counterpart International application No. PCT/FR2015/050111, dated Aug. 18, 2016.

(Continued)

*Primary Examiner* — Charles P Cheyney
(74) *Attorney, Agent, or Firm* — Sughrue Mion, PLLC

(57) ABSTRACT

A fluid reservoir including a neck that defines an opening in which a stopper is engaged. The stopper is movable by sliding in the neck between a high closed initial position in which the stopper hermetically closes the opening of the neck and a low open final position in which at least one feed passage puts the inside of the reservoir into communications with the outside.

11 Claims, 2 Drawing Sheets

(58) Field of Classification Search
CPC ..... B05B 11/0048; B05B 11/3028; B05B 11/3047; B05B 11/3069; B05B 11/0054; A45D 34/00
USPC ..... 222/522–526, 507, 559, 383.1, 90, 82, 222/492, 401, 402, 380
See application file for complete search history.

(56) References Cited

U.S. PATENT DOCUMENTS 4,493,444 A 1/1985 Del Bon et al.
4,696,411 A * 9/1987 Graf ..... B01J 4/001 141/326
5,297,697 A * 3/1994 Boring ..... B05C 17/00516 137/68.23
5,579,953 A * 12/1996 Perkins ..... B65D 77/067 222/1
5,873,872 A * 2/1999 Thibault ..... A61J 1/2089 604/403
6,354,473 B1 * 3/2002 Brambach ..... B65D 47/247 141/349
6,412,659 B1 7/2002 Kneer
6,644,519 B2 * 11/2003 Last ..... B65D 47/283 141/351
7,448,418 B1 * 11/2008 Tuyls ..... F16L 21/08 141/114
9,486,826 B2 * 11/2016 Taberlet ..... B05B 11/3047

OTHER PUBLICATIONS

International Search Report of PCT/FR2015/050111 dated Apr. 17, 2015.

* cited by examiner

FLUID PRODUCT RESERVOIR AND DISPENSER INCORPORATING SUCH A RESERVOIR

CROSS REFERENCE TO RELATED APPLICATIONS

This application is a National Stage of International Application No. PCT/FR2015/050111 filed Jan. 16, 2015, claiming priority based on French Patent Application No. 1450382 filed Jan. 17, 2014, the contents of all of which are incorporated herein by reference in their entirety.

The present invention relates to a fluid reservoir including a neck defining an opening in which a stopper is engaged. The reservoir is for associating with a dispenser member, such as a pump or a valve, so that together they constitute a fluid dispenser. While mounting the dispenser member on the reservoir, a feed passage needs to be established so as to put the inside of the reservoir into communication with the inlet of the dispenser member. Advantageous fields of application of the present invention are the fields of cosmetics, perfumery, and pharmacy, in which the reservoir of the invention may be used as a refill or a cartridge.

In the prior art, fluid reservoirs provided with stoppers so as to close the openings of the necks have been known for some time. The term "stopper" should be understood in its broadest sense, i.e. encompassing any closure, covering, or shutting element that is suitable for closing the opening of the neck, so as to preserve the fluid contained in the reservoir against any deterioration, contamination, or damage. Thus, prior-art stoppers may be in the form of stoppers for pushing into the necks, stoppers for screw-fastening or snap-fastening around the necks, and films or membranes for adhesively-bonding on the edges of the openings of the necks. Thus, while the dispenser member is being mounted on such reservoirs, either the stopper is removed beforehand, or it is perforated or torn by an element of the dispenser member while it is being inserted through the neck. With a stopper for screw-fastening or snap-fastening, the question arises of disposing of the stopper that no longer has a function. With membranes or films for perforating or tearing, debris may fall into the fluid and this may contaminate it or damage the dispenser member.

An object of the present invention is to remedy the above-mentioned drawbacks of the prior art by defining a fluid reservoir, e.g. of refill or cartridge type, that is fitted with a stopper that is suitable for defining a feed passage that is guaranteed, of the right size, clean, and without creating pieces to be thrown away or to be perforated, and without leaving debris in the fluid.

To do this, the present invention proposes a fluid reservoir including a neck that defines an opening in which a stopper is engaged, the reservoir being characterized in that the stopper is movable by sliding in the neck between a high closed initial position in which the stopper hermetically closes the opening of the neck and a low open final position in which at least one feed passage puts the inside of the reservoir into communications with the outside. The stopper is thus intended to remain in place in the opening of the neck, with the stopper moving in order to create the feed passage.

In an advantageous embodiment, the stopper includes an annular sealing lip that is in sealed contact with the neck in the high closed initial position, and that is not in sealed contact with the neck in the low open final position, thereby defining said at least one feed passage between the stopper and the neck. Thus, the annular sealing lip slides in sealed manner in the neck over a certain height, then separates from the neck in the proximity of the low open final position so as to create the feed passage(s). Advantageously, the stopper may include an annular guide lip that is in permanent sliding contact with the neck between the initial and final positions, so as to guide the stopper while it is moving in the neck. In other words, the annular guide lip never loses contact with the neck while it is sliding. However, the annular guide lip does not necessarily guarantee sealed contact over the entire inner periphery of the neck.

In another advantageous aspect of the invention, said at least one feed passage is defined between the sealing and guide lips. The feed passage may even extend to the annular guide lip, but it must not extend to the annular sealing lip. In a practical embodiment, the sealing and guide lips may be formed at two opposite annular edges of a bushing, said at least one feed passage extending through the bushing. Preferably, the bushing forms at least one vertical slot that interrupts the guide lip and that defines the feed passage. The slot may extend to the proximity of the annular sealing lip, without interrupting it.

According to another advantageous characteristic of the invention, the stopper may include a dish that extends downwards from the bushing. It can also be said that the bushing defines an edge or top rim of the dish.

One of the principles of the present invention is to provide the neck of a reservoir with a sliding stopper that remains secured to the neck continuously, but that closes it in its high initial position, and that defines at least one feed passage in its low final position.

The present invention also defines a fluid dispenser comprising a dispenser member, such as a pump, associated with a fluid reservoir as defined above. The dispenser member includes a thrust element that comes into contact with the stopper so as to move it from its closed initial position to its open final position. Advantageously, the dispenser member may include a body that defines a fluid inlet, the body being received in a fastener ring that includes fastener means for fastening around the neck of the reservoir, the thrust element being formed by the fastener ring, advantageously in the form of an annular flange that extends downwards into the neck so as to come into contact with the stopper. Thus, while the dispenser member is being mounted on the reservoir, the fastener means come into engagement around the neck of the reservoir and, simultaneously, the annular flange drives the stopper into the neck until it reaches its open final position.

According to a characteristic of the invention, the body may extend into the stopper. More concretely, the body of the dispenser member is arranged inside the dish of the stopper.

In another practical aspect, the fastener means may include a thread that is engaged with threads that are formed on the outside of the neck.

The reservoir of the present invention may advantageously be used as a refill or a cartridge that is suitable for associating with a dispenser member in order to constitute a fluid dispenser. Once the reservoir is empty, it is quite simply replaced by a new full reservoir. This is a preferred application of the reservoir of the present invention, but it is not the only application or limiting.

The invention is described more fully below with reference to the accompanying drawings, which show an embodiment of the invention by way of non-limiting example.

Figure 2:
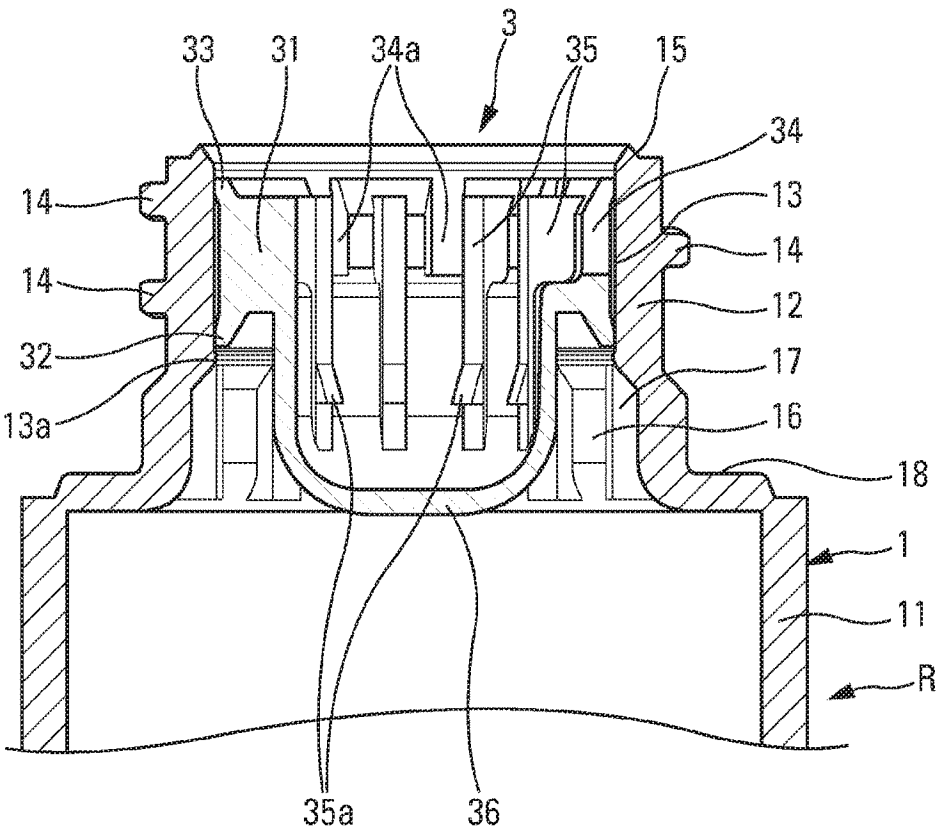
FIG. 2 is a greatly enlarged view of the top portion of the FIG. 1 dispenser.
Figure 1:
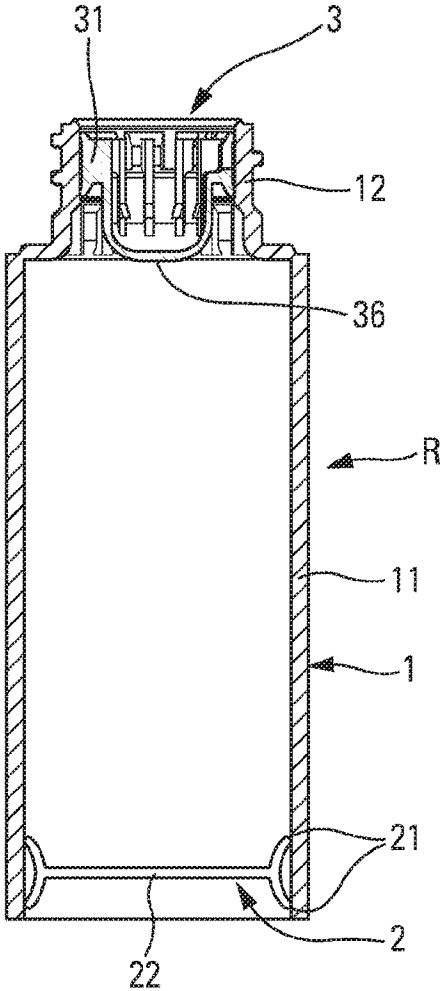
FIG. 1 is a vertical section view through a fluid reservoir in an embodiment of the invention.

Reference is made firstly to FIGS. 1 and 2 in order to describe, in detail, the structure of a fluid reservoir R made in accordance with a non-limiting embodiment of the invention. The reservoir R comprises three component elements, namely a main body 1, a follower piston 2, and a stopper 3. The three elements may be made by injection-molding appropriate plastics material. However, the main body 1 may alternatively be made with other materials, e.g. glass, metal, composite materials, etc. The same applies for the stopper 3 that could possibly be made out of metal or out of composite material.

The main body 1 of the reservoir R comprises a cylinder 11 of any section, but preferably of circular section. Its bottom end may be open, while its top end forms a neck 12 that defines an opening in which the stopper 3 is engaged. More precisely, the neck 12 extends upwards from an annular shoulder 18 that is connected to the cylinder 11. The inside of the neck 12 defines a slide cylinder 13 that is interrupted in its bottom portion by recesses 16 that are separated by vertical blades 17 that extend radially inwards. The inside vertical sharp edges of the blades 17 advantageously extend flush with the slide cylinder 13. Optionally, an annular rim 13*a* may indicate the bottom end of the slide cylinder 13 or the connection of the slide cylinder 13 with the vertical blades 17. The annular bead 13*a* projects inwards a little so as to reduce the opening of the neck 12 locally. At its top end, the neck 12 defines an annular edge 15, possibly provided with an annular sealing rim. On its outside face, the neck 12 defines one or more screw threads 14.

The follower piston 2 may be of entirely conventional type, e.g. comprising two piston lips 21 connected to a bottom wall 22. The follower piston 2 is for sliding in sealed manner inside the cylinder 11 as the fluid is removed from the reservoir R. The follower piston 2 moves inside the cylinder 11 as a result of suction being generated inside the reservoir R. Instead of the follower piston 2, it is also possible to envisage a flexible pouch that deforms under the effect of suction.

The stopper 3 is slidably engaged inside the neck 12. In its high closed initial position shown in FIGS. 1 and 2, the stopper 3 is in sealed and shutting engagement with the slide cylinder 13. In other words, in this high closed initial position, the stopper 3 shuts, seals, or closes the opening formed by the neck 12 of the reservoir R in airtight and leaktight manner. Thus, the fluid stored inside the reservoir R is protected from the outside environment.

In the embodiment used to illustrate the present invention, the stopper 3 includes an annular bushing 31 from which a dish 36 extends downwards, which dish defines an internal reception space having a function that is explained below. In order to reinforce the strength of the stopper 3, vertical radial splines 35 extend over the height of the bushing and of the dish 36. The annular bushing 31 defines a low annular sealing lip 32 that is continuous over its entire periphery, and that comes into sealed contact with the slide cylinder 13 in the high closed initial position, shown in FIGS. 1 and 2. The bushing 31 also defines a high annular guide lip 33 that also comes into contact with the slide cylinder 13. It can thus be said that the two lips 32 and 33 are formed at outer opposite edges of the bushing 31. The bushing 31 also defines a plurality of feed passages 34 that pass radially through the thickness of the bushing 31. In this embodiment, the feed passages 34 are formed by vertical slots or notches 34*a* that are open at their top ends so as to interrupt the high annular guide lip 33. As a result, the guide lip 33 does not perform a peripheral sealing function. In a variant that is not shown, the feed passages could merely pass radially through the bushing 31 between the low sealing lip 32 and the high guide lip 33, without interrupting them. It is even possible to envisage a single through opening that is in the form of a horizontal slot or window that extends over a fraction of the periphery of the bushing 31. Making the feed passages 34 in the form of vertical slots 34*a* that open upwards merely constitutes one practical embodiment, which enables the stopper to be made in extremely simple manner by injection-molding plastics material with a mold that has only two parts. Forming upwardly-open vertical slots 34*a* defines separate tabs that extend upwards and that are each reinforced by a spline 35. The outer top edge of the tabs forms the annular guide lip 33 that is interrupted by the vertical slots. However, in the high closed initial position in FIGS. 1 and 2, the reservoir is closed in sealed manner by the annular sealed contact of the low sealing lip 32 with the slide cylinder 13. Advantageously, the sealing lip 32 comes to bear against the annular rim 13*a* formed at the bottom end of the slide cylinder 13, as can be seen clearly in FIG. 2.

Thus, when the stopper 3 is in its high closed initial position, it performs a closure, plugging, or sealing function quite simply so as to preserve the fluid stored inside the reservoir where it is protected from the outside air.

It should also be observed that the splines 35 may be provided with teeth 35*a* that are oriented downwards, and having a function that is explained below.

Figure 4:
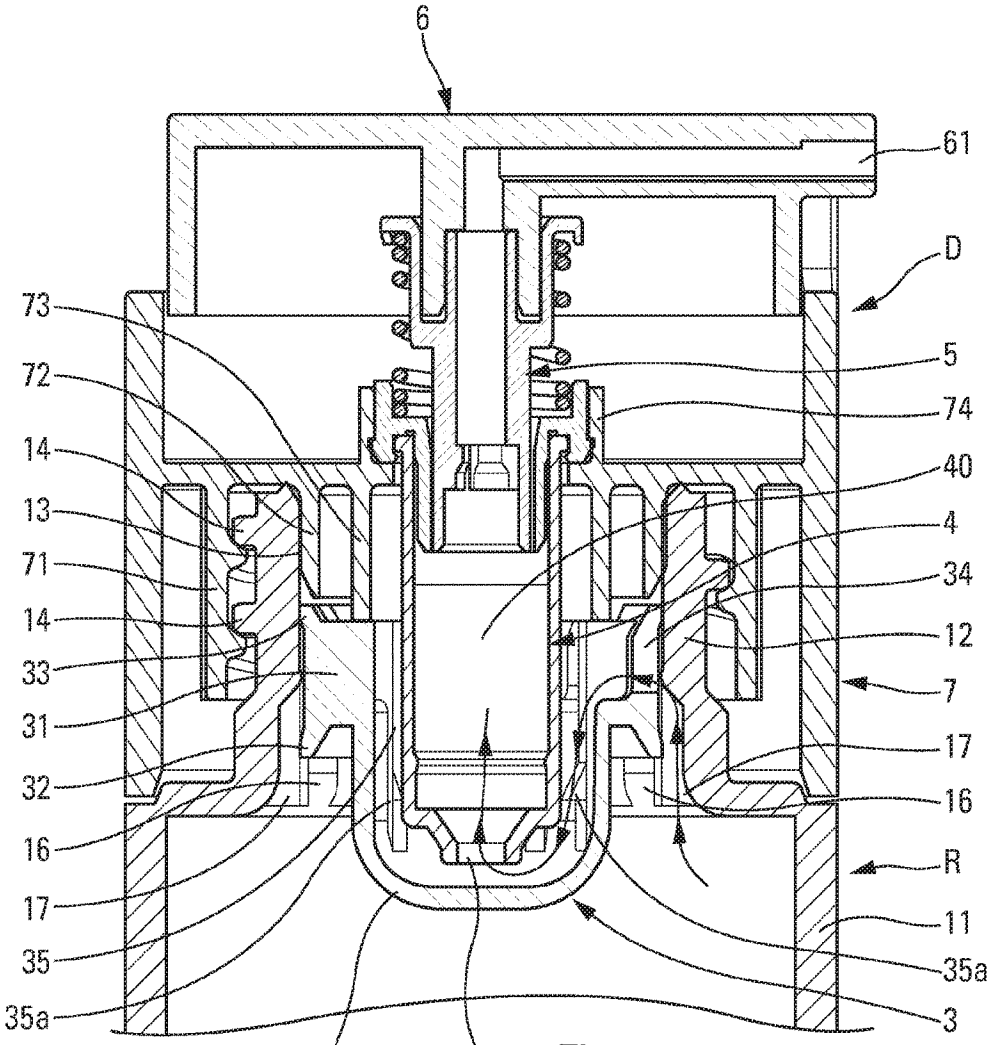
FIG. 4 is a greatly enlarged view of the top portion of the FIG. 3 dispenser.
Figure 3:
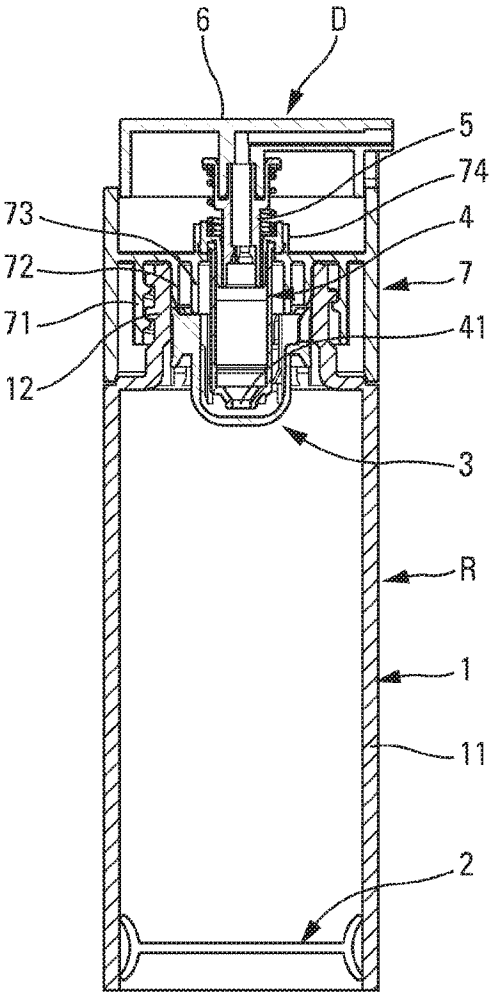
FIG. 3 is a vertical section view through a fluid dispenser incorporating the reservoir in FIGS. 1 and 2.

Reference is made below to FIGS. 3 and 4 in order to describe in detail the positioning of the stopper 3 inside the neck 12 when a dispenser member D is mounted on the reservoir R. The dispenser member D is preferably a pump, but it could possibly be a valve. The dispenser member D comprises a body 4 inside which an actuator rod 5 is mounted, which actuator rod is axially movable down and up. At its bottom end, the body 4 forms a fluid inlet 41 that is advantageously provided with an inlet valve member (not shown). In addition, the actuator rod 5 forms, incorporates, or supports an outlet valve member. Between the two valve members, the body 4 forms a chamber 40 in which a dose of fluid can be put under pressure. Specifically, by driving the rod 5 into the body 4, the fluid contained in the chamber 40 is put under pressure in such a manner as to close the inlet valve member and open the outlet valve member. Thus, fluid under pressure is forced through the rod 5. In entirely conventional manner, a pusher 6 is mounted on the rod 5 so as to be able to exert axial thrust on the actuator rod 5. Furthermore, the pusher 6 forms a dispenser orifice 61 from where the fluid that flows through the actuator rod 5 is dispensed so as to be collected by the user. In addition, the dispenser member D also includes a fastener ring 7 that makes it possible to mount the body 4 in the neck 12 in stationary and sealed manner. The fastener ring 7 may include a fastener skirt 71 that, on its inside, is provided with a thread that is suitable for coming into engagement with the screw threads 14 of the neck 12. The fastener ring 7 may also include a sealing collar 72 for coming into sealed engagement inside the slide cylinder 13. Naturally, the fastener ring 7 includes reception means 74 for receiving the body 4 in stationary and sealed manner. In the invention, the fastener ring 7 also includes an annular thrust flange 73 that extends downwards in such a manner as to define a bottom thrust edge that comes into bearing contact with the stopper 3, and more precisely with the top face of the bushing 31, as can be seen clearly in FIG. 4. The stopper 3 is then in its low open final position in which the feed passages 34 enable communication between the reservoir R and the fluid inlet 41, as shown by the line provided with arrows in FIG. 4. It can easily be understood that screw-fastening the skirt 71 on the neck 12 has the effect of pushing the stopper 3 further into the neck 12 by causing it to slide. In the low open final position shown in FIGS. 3 and 4, it should be observed that the guide lip 33 is still in engagement with the slide cylinder 13, while the low sealing lip 32 is now arranged level with the vertical radial blades 16, such that it can no longer perform a peripheral annular sealing function. The feed openings 34 formed by the vertical slots then communicate with the recesses 16 formed between the blades 17. Although it no longer performs a sealing function, the low sealing lip 32 still performs a guide function, remaining in contact with the inside vertical sharp edges of the blades 17. This makes it possible, in co-operation with the high guide lip 33, to guarantee axial stability for the stopper 3 whatever its position. It should also be observed that the body 4 of the dispenser member D is arranged inside the dish 36 without creating sealing. After passing through the feed passages 34, the fluid may flow between the reinforcement splines 35 so as to reach the fluid inlet 41 that is arranged away from the bottom of the dish 36. The teeth 35*a* formed on the splines 35 come into contact with the body 4: as a result of their orientation, they do not prevent the body from descending into the dish 36, but they catch onto the body in the opposite direction when the dispenser member D is removed from the reservoir. This causes the stopper 3 to slide in the neck in such a manner as to close the feed openings 34. By way of example, the teeth 35*a* are released from the body 4 when the sealing lip 32 comes to bear in sealed manner below the annular bead 13*a*. The reservoir is thus once again closed in sealed manner. In this embodiment, the teeth 35*a* are formed on the splines, but they may be implemented anywhere on the stopper or on the dispenser member for the purpose of closing the reservoir while the dispenser member is being removed.

Although not shown, the stopper 3 may create peripheral sealing with the body 4 above the feed passages 34. For example, it is possible to envisage that the feed passages pass through the bushing 31 without interrupting the high guide lip 33, and that the bushing 31 also forms a high inner lip that is in sealed contact with the body 4. In this variant, the fastener ring 7 need not have a sealing collar 72. It is also possible to envisage that the body 4 bears directly on the stopper 3 so as to move it from its closed initial position to its open final position. The fastener ring 7 thus need not have an annular thrust flange 73. Regardless of the modifications that might be envisaged, the stopper 3 still performs a closure function in its high initial position, is moved by sliding in the neck by means of the dispenser member D, and adopts a low final position in which one or more feed openings are defined.

The invention claimed is:

1. A fluid dispenser comprising a dispenser member associated with a fluid reservoir;

the fluid reservoir comprising a neck that defines an opening in which a stopper is engaged, the stopper is movable by sliding in the neck between a high closed initial position in which the stopper hermetically closes the opening of the neck, and a low open final position in which at least one feed passage puts the inside of the reservoir into communications with the outside;

the dispenser member including a thrust element that comes into contact with the stopper so as to move the stopper from the closed initial position to the open final position;

the dispenser member includes a body that defines a fluid inlet, the body being received in a fastener ring that includes fastener means for fastening around the neck of the reservoir, the thrust element being formed by the fastener ring, and the body extending into the stopper;

wherein the stopper includes an annular bushing and the at least one feed passage extends through the bushing;

wherein the stopper includes a dish that extends downwards from the bushing, and the dish defines an internal reception space;

wherein the body extends inside the internal reception space such that the dish surrounds at least a portion of the body.

2. The dispenser according to claim 1, wherein the stopper includes an annular sealing lip that is in sealed contact with the neck in the high closed initial position, and that is not in sealed contact with the neck in the low open final position, thereby defining said at least one feed passage between the stopper and the neck.

3. The dispenser according to claim 2, wherein the stopper includes an annular guide lip that is in permanent sliding contact with the neck between the initial and final positions, so as to guide the stopper while it is moving in the neck.

4. The dispenser according to claim 3, wherein said at least one feed passage is defined between the sealing and guide lips.

5. The dispenser according to claim 4, wherein the sealing and guide lips are formed at two opposite annular edges of the bushing.

6. The dispenser according to claim 5, wherein the bushing forms at least one vertical slot that interrupts the guide lip and that defines the feed passage.

7. The dispenser according to claim 1, wherein the thrust element has an annular flange that extends downwards into the neck so as to come into contact with the stopper.

8. The dispenser according to claim 1, wherein the fastener means include a thread that is engaged with threads that are formed on an outside of the neck.

9. The dispenser according to claim 1, wherein the dispenser member is a pump.

10. The dispenser according to claim 1, wherein the stopper includes a dish that extends downwards forming a distal end of the stopper and that, in the open final position, defines a fluid passage between an interior side of the dish and the dispenser member, the fluid passage communicating with the at least one feed passage to deliver fluid to an inlet of the dispenser member.

11. The dispenser according to claim 10, wherein, in the open final position, the distal end of the stopper extends beyond a lower distal end of the dispenser member into the reservoir.

* * * * *